US006929096B1

(12) United States Patent
Goldberg

(10) Patent No.: US 6,929,096 B1
(45) Date of Patent: Aug. 16, 2005

(54) STRINGER/SHELF FRAME CONSTRUCTION

(75) Inventor: Mark A. Goldberg, Lido Beach, NY (US)

(73) Assignee: Systemax, Inc., Port Washington, NY (US)

( * ) Notice: Subject to any disclaimer, the term of this patent is extended or adjusted under 35 U.S.C. 154(b) by 0 days.

(21) Appl. No.: 10/323,498

(22) Filed: Dec. 19, 2002

(51) Int. Cl.[7] ..... E04G 1/00; E04G 1/34

(52) U.S. Cl. ..... 182/181.1; 182/153; 182/224; 108/156

(58) Field of Search ..... 182/181.1, 153, 182/151, 225, 229, 182.9, 155, 186.5, 186.2, 182/186.1; 211/186, 187; 108/106, 144, 108/156, 157, 159, 15, 157.1, 157.13, 158, 108/93, 101, 187, 147.19, 147.21

(56) References Cited

U.S. PATENT DOCUMENTS

| | | | | | |
|---|---|---|---|---|---|
| 1,103,699 | A | | 7/1914 | South | |
| 1,147,522 | A | | 7/1915 | Loomis | |
| 1,226,112 | A | | 5/1917 | Pepin | |
| 1,243,520 | A | | 10/1917 | Helwig | |
| 2,435,060 | A | | 1/1948 | Thomson | |
| 2,859,066 | A | | 11/1958 | Franklin | |
| 2,972,506 | A | * | 2/1961 | Haag | 108/64 |
| 3,187,693 | A | * | 6/1965 | Hamilton et al. | 108/157.13 |
| 3,696,763 | A | * | 10/1972 | Evans | 108/157.13 |
| 3,734,235 | A | | 5/1973 | Lanier | |
| 4,300,455 | A | * | 11/1981 | Ornati | 108/156 |
| 4,351,246 | A | * | 9/1982 | Hutchins, Jr. | 108/156 |
| 4,491,226 | A | * | 1/1985 | Marschak | 108/187 |
| 4,756,384 | A | | 7/1988 | Maddox | |
| 4,776,545 | A | | 10/1988 | Miyamoto | |
| 4,782,917 | A | | 11/1988 | Schulz | |
| 4,877,109 | A | | 10/1989 | Welch et al. | |
| 4,998,697 | A | | 3/1991 | Esposito | |
| 5,092,427 | A | * | 3/1992 | MacMillan | 182/186.1 |
| 5,265,697 | A | * | 11/1993 | Quick | 182/151 |
| 5,297,305 | A | * | 3/1994 | Williams | 108/158 |
| 5,402,860 | A | | 4/1995 | Fry | |
| 5,954,156 | A | | 9/1999 | Cooke | |
| 6,209,683 | B1 | | 4/2001 | Holtz | |
| 6,283,250 | B1 | | 9/2001 | Asher | |

FOREIGN PATENT DOCUMENTS

| | | | | |
|---|---|---|---|---|
| GB | 2034177 | A * | 6/1980 | A47B 13/00 |

* cited by examiner

*Primary Examiner*—Hugh B. Thompson, II
(74) *Attorney, Agent, or Firm*—Gibbons, Del Deo, Dolan, Griffinger & Vecchione

(57) ABSTRACT

A workbench frame having spanning element with a stringer portion and a shelf portion with a bend extending along an entire length between the stringer and shelf portions. The stringer and shelf portions each accommodate fastening elements that secure to opposite leg assemblies to provide stability, support and storage space.

9 Claims, 3 Drawing Sheets

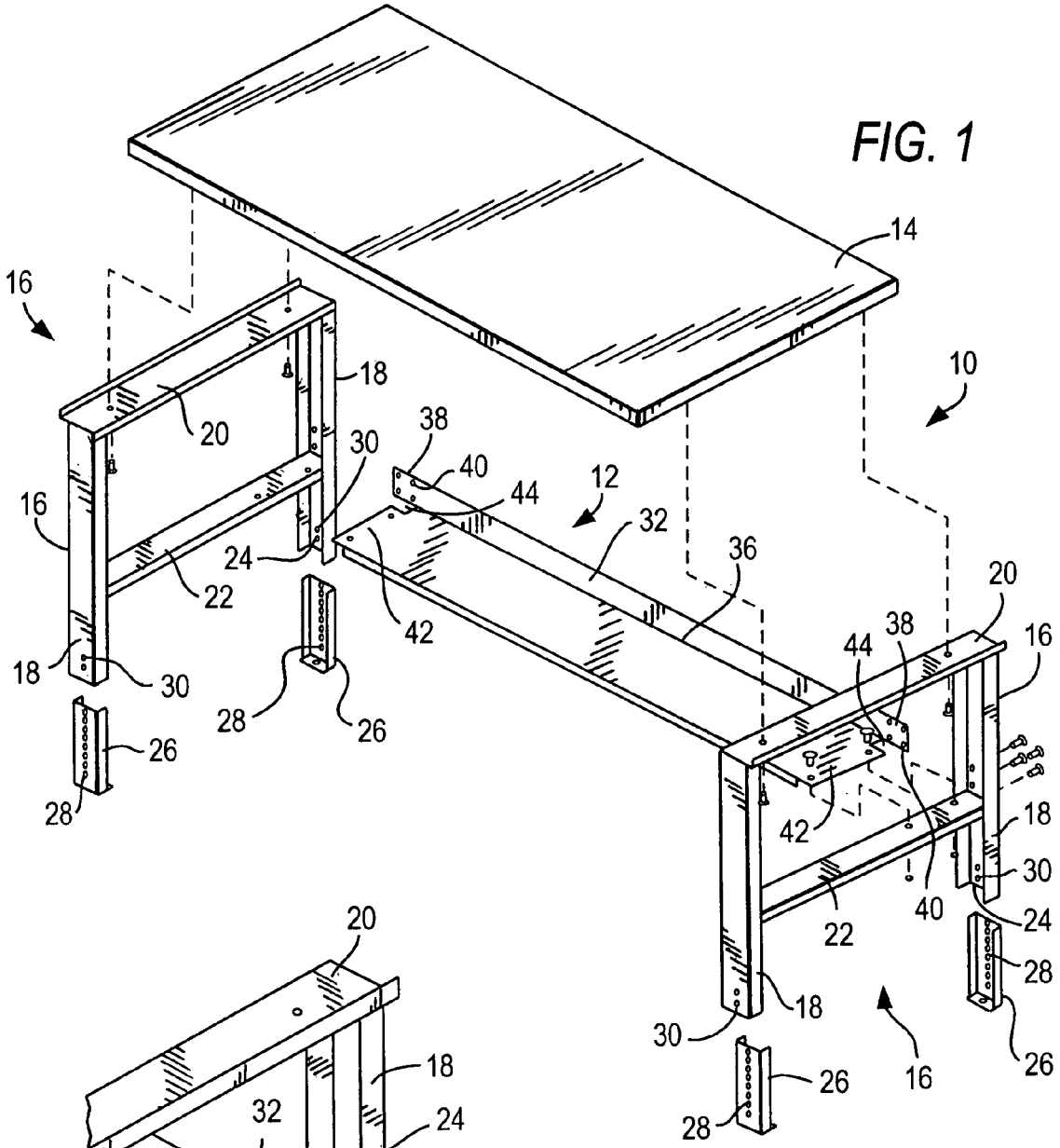
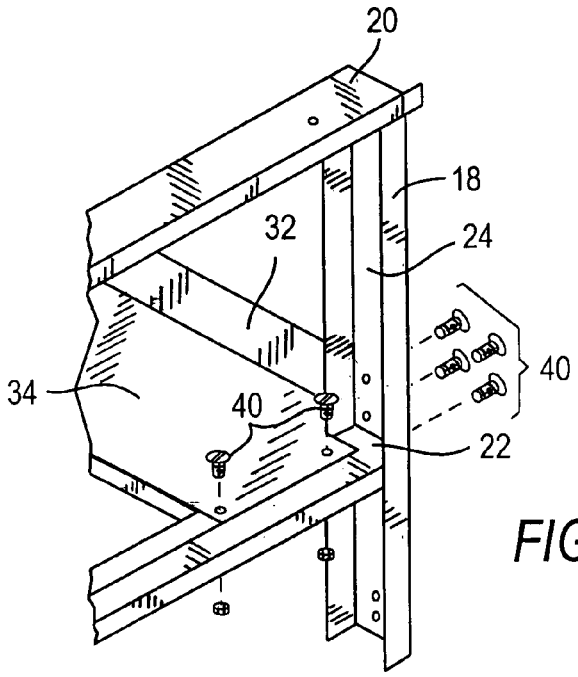
FIG. 2

FIG. 3
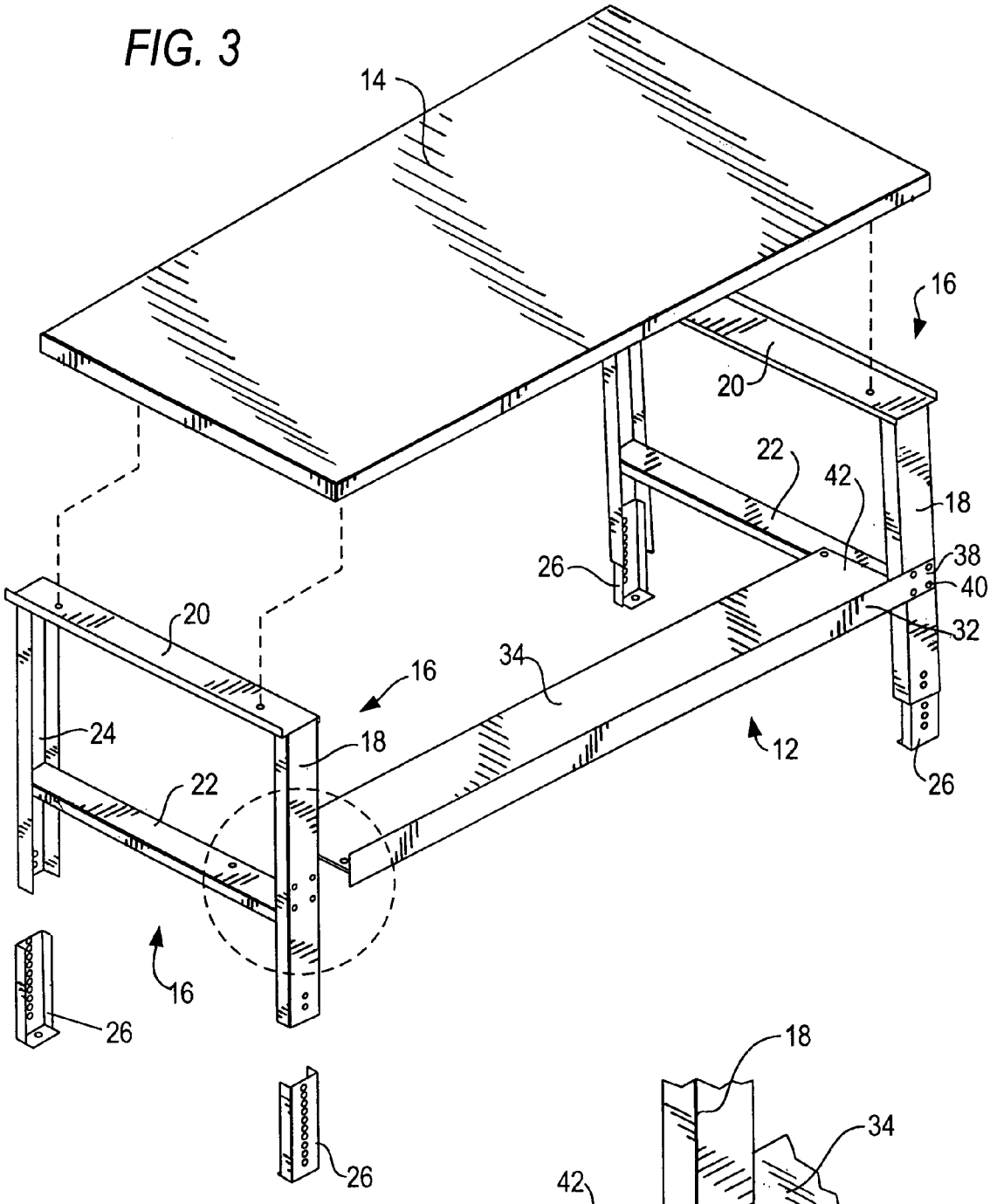
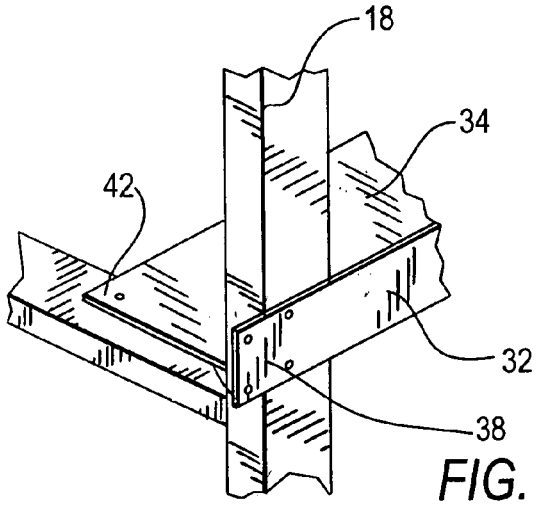
FIG. 4

STRINGER/SHELF FRAME CONSTRUCTION

BACKGROUND OF THE INVENTION

1. Field of the Invention

The present invention relates to a stringer and a shelf as part of a frame for a workbench, table, workstation or other like furniture.

2. Description of Related Art

Stringers are used to span between rear legs of a workbench, table, workstation or other like furniture to provide stability against toppling. Shelves are generally attached toward the front to an underside of a working surface atop the workbench, table, workstation or like furniture or as part of a hutch.

It would be desirable to enhance stability to the workbench, table, workstation or other like furniture beyond that afforded by a stringer alone and yet provide for additional shelf space.

SUMMARY OF THE INVENTION

One aspect of the invention relates to a stringer and shelf unit attached to opposing leg assemblies of a workbench, table, workstation or other like furniture to provide stability against toppling. The stringer and shelf may extend in respective planes that are substantially perpendicular to each other. Preferably, the shelf has two recesses that each conform in configuration to an exterior of respective ones of the legs of the leg assemblies so as to accommodate the one leg and be flush against it.

BRIEF DESCRIPTION OF THE DRAWING

For a better understanding of the present invention, reference is made to the following description and accompanying drawings, while the scope of the invention is set forth in the appended claims:

FIG. 1 is a perspective, exploded view of a workbench in accordance with the invention in an unassembled condition.

FIG. 2 is a perspective view of connection region of a stringer-shelf portion of FIG. 1.

FIG. 3 is a perspective view of the workbench of FIG. 1 in accordance with the invention in a partially assembled condition.

FIG. 4 is a perspective view of the connection region of the stringer-shelf portion of FIG. 3.

DETAILED DESCRIPTION OF THE INVENTION

Figure 5:
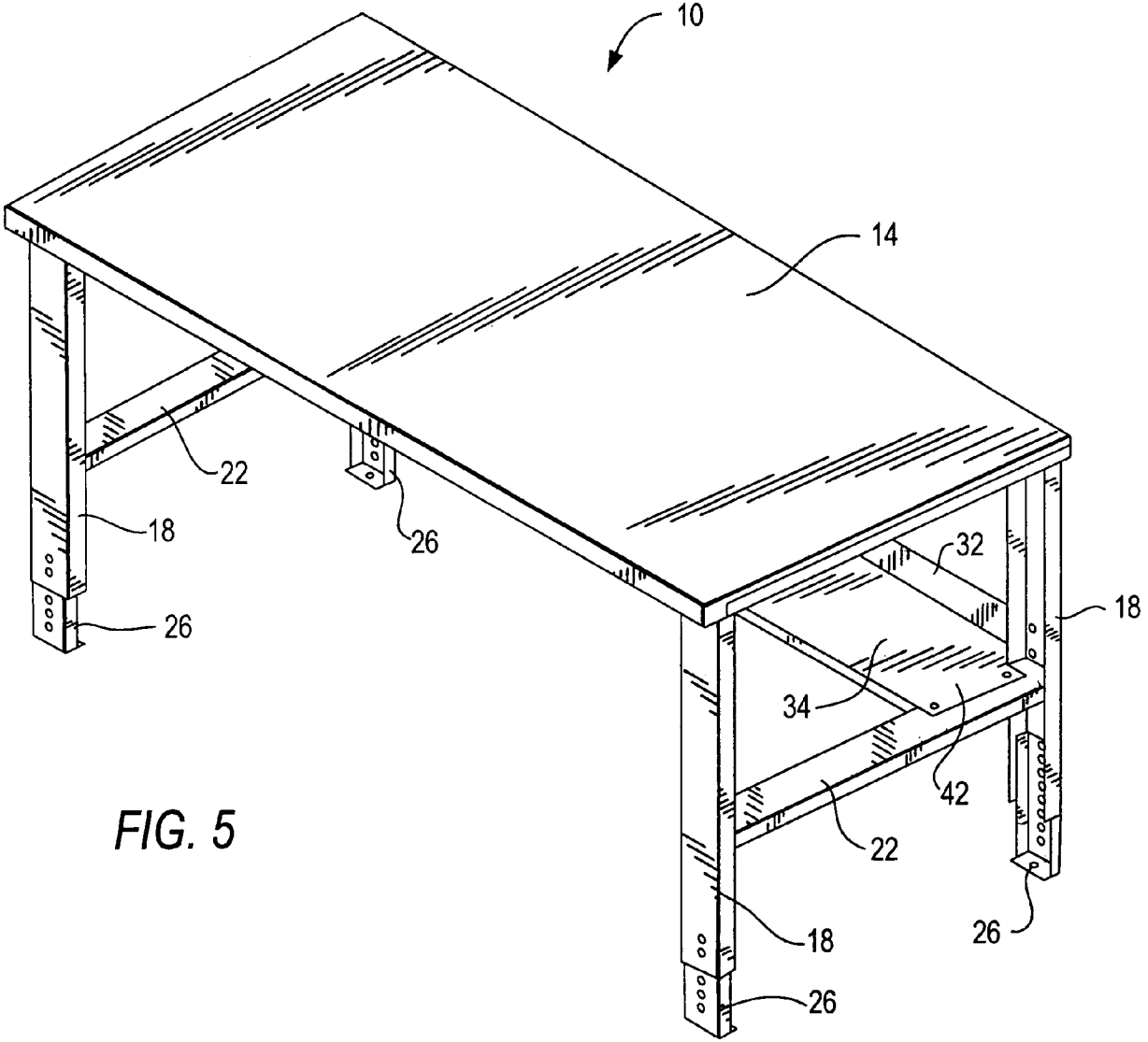
FIG. 5 is a perspective view of of the workbench of FIG. 1 in accordance with the invention in a fully assembled condition.

Turning to the drawings, FIGS. 1, 3 and 5 show a workbench 10 in progressive stages of assembly. FIGS. 2 and 4 show enlargements of a stringer/shelf unit 12. The workbench 10 has various components, namely, a flat, working surface element 14 and two pairs of leg assemblies 16. Each pair of leg assemblies 16 include two legs 18, a flared cross piece 20 that spans across a gap between ends of each of the two legs 18, and a cross-member 22 that spans between the legs 18 at a lower elevation and whose ends fit within a respective channel 24 in each of the two legs 18. As is known, adjustable feet 26 are provided that are adjustably attached to the legs 18 respectively and permit relative positioning of the feet 26 relative to the legs 18 in any one of a plurality of different relative positions. Each foot has a series of punch-outs 28 any of which being capable of insertion into holes 30 in the legs 18. The flat, working surface element 14 sits on the flared cross pieces 20 between the flared portions and is fastened in place in a conventional manner with conventional fasteners.

Enhanced stability is provided by using the stringer/shelf unit 12 that has an elongated stringer portion 32 and an elongated shelf portion 34. The stringer/shelf 12 is preferably formed as a single piece construction that is integrally forms the stringer and shelf portions 32, 34 together, without the need for any adhesive or fastening elements to retain the stringer and shelf portions 32, 34 together. Alternatively, the stringer and shelf portions 32, 34 are not integrally formed with each other but rather separate elements that are secured to each with fasteners or adhesive, thereby providing in effect a single piece construction.

Together, the stringer portion 32 and the shelf portion 34 form an elongated bend 36 between them and preferably extend in planes substantially angled to each other, preferably perpendicular or oblique to each other. The stringer portion 32 each span the distance between opposing leg assemblies 16. The stringer portion 32 is fastened to a rear leg of each of the leg assemblies 16, while the shelf portion 34 is fastened to the cross-members 22 of each of the leg assemblies 16 and is fastened to two rear legs, i.e. one leg from each of the assemblies 16.

The stringer portion 32 has two ends 38, preferably formed with holes 40 into which fasteners are inserted to secure the stringer portion 32 to an outward face of each rear leg of the leg assemblies 16. The shelf portion 34 also has two ends 42 each with holes into which fasteners are inserted to secure the ends 42 of the shelf portion 34 to a respective one of the further cross-members 22. The ends 42 each also define a recess 44 that terminates the bend 36 and is bounded by respective ones of the end 38 of the stringer portion 32. Each recess 44 is sized to accommodate insertion of a respective one of the rear legs so that the shelf lies flat and horizontal on surfaces of the cross-members 22.

The recesses 44 are configured to conform in shape with and be flush against the exterior of respective ones of the rear legs 18. This prevents small items that may rest on the shelf from inadvertently falling between a gap between the shelf and the rear legs, which gap is either not present in the present invention because of the flush fit or is sufficiently small in size that small items (such as screws or bolts or nuts or washers) that may be placed on the shelf do not fit through such a gap readily if at all. In addition, the stringer portion 32 serves as a backrest or backstop for whatever items are placed on the shelf portion 34 if necessary.

The assembly of the workbench 10 involves securing the leg assemblies 16 and then securing the stringer/shelf unit 12 to the leg assemblies with fasteners 40. The fasteners 40 are inserted through holes in alignment as between the shelf portion 34 and the cross-member 22 and as between the stringer portion 32 and the legs 18. The feet 28 are attached to the base of each of the legs 18 to provide desired elevation. The flat, working surface element 14 is then placed atop the flared cross pieces 20 between upwardly flared ends of the cross pieces. 20. The progression of assembly is therefore represented by FIGS. 1, 3 and then 5 in succession. Disassembly would be in reverse sequence to that for assembly.

While the foregoing description and drawings represent the preferred embodiments of the present invention, it will be understood that various changes and modifications may be made without departing from the spirit and scope of the present invention.

What is claimed is:

1. A frame, comprising:

two leg assemblies and a unit, the unit having an elongated stringer portion and an elongated shelf portion that extend in respective planes that arm angled relative to each other, each of the leg assemblies including at least one cross-member and at least two legs, each of the two legs being connected to the cross member, the elongated stringer portion being connected to one of the two legs of each of the two leg assemblies, the elongated shelf portion being connected to each of the cross-members of the two leg assemblies.

2. A frame as in claim 1, wherein the respective planes in which the elongated stringer and shelf portions extend are substantially perpendicular to each other.

3. A frame as in claim 1, wherein the one of the two legs of each of the leg assemblies have a side with a dimension that faces the elongated shelf portion, the elongated shelf portion being configured with two recessed edges that are each sized to accommodate the dimension of a respective one of the sides of the legs so that the two recessed edges and the sides of the legs may be arranged flush against each other, respectively.

4. A frame as in claim 1, wherein each of the two leg assemblies include a flared cross-member that connects the two legs of respective ones of the two leg assemblies and has a flared portion that flares outwardly so as to accommodate placement of a flat, working surface element that spans a distance between the flared portions.

5. A frame as in claim 1, wherein the elongated stringer portion and the elongated shelf portion are integrally formed with each other to define a bend between and that are held to each other without reliance on any adhesive or fastening elements.

6. A frame as in claim 1, wherein the respective planes in which the elongated stringer and shelf portions extend are oblique to each other.

7. A frame, comprising:

two leg assemblies, and a unit having an elongated stringer portion and an elongated shelf portion each extending in respective planes that are angled relative to each other, the shelf and stringer portions forming a bend that extends in a direction of elongation of the shelf and stringer portions, the shelf portion including a recess configuration arranged so that the bend is between the recess configurations, the stringer portion being longer than the bend and having edges that bound a side of each of the recess configurations, the stringer and shelf portions each having opposite ends formed with apertures into which fastening elements may be inserted, wherein the leg assemblies further comprising holes and wherein the fastening elements are inserted through the apertures and the holes to attach the leg assemblies to the stringer portion.

8. A frame as in claim 7, wherein the respective planes in which the stringer and shelf portions extend are substantially perpendicular to each other.

9. A frame as in claim 7, wherein the respective planes in which the elongated stringer and shelf portions extend are oblique to each other.

* * * * *